US005333798A

United States Patent [19]

Paliard et al.

[11] Patent Number: 5,333,798

[45] Date of Patent: Aug. 2, 1994

[54] METHOD AND SYSTEM FOR POUNDING BRITTLE MATERIAL

[75] Inventors: Maurice Paliard, Saint Etienee; Jacques Duputs, Chazay d'Azergues, both of France

[73] Assignee: CLE, Courbevote, France

[21] Appl. No.: 804,125

[22] Filed: Dec. 6, 1991

[30] Foreign Application Priority Data

Dec. 6, 1990 [FR] France ..... 90 15316

[51] Int. Cl.[5] ..... B02C 23/10

[52] U.S. Cl. ..... 241/24; 241/80; 241/97

[58] Field of Search ..... 241/18, 24, 80, 78, 241/97

[56] References Cited

U.S. PATENT DOCUMENTS

| | | | |
|---|---|---|---|
| 3,942,727 | 3/1976 | Fahlström et al. | 241/34 |
| 4,703,897 | 11/1987 | Beisner et al. | 241/24 |
| 4,726,531 | 2/1988 | Strasser | 241/19 |
| 4,728,044 | 3/1988 | Duill et al. | 241/18 |
| 4,840,315 | 6/1989 | Rubin et al. | 241/24 |
| 4,976,469 | 12/1990 | Paliard et al. | 241/24 |
| 5,005,770 | 4/1991 | Suessegger | 241/19 |
| 5,114,131 | 5/1992 | Strasser et al. | 241/19 |
| 5,154,362 | 10/1992 | Knobloch et al. | 241/24 |

FOREIGN PATENT DOCUMENTS

| | | |
|---|---|---|
| 0023320 | 2/1981 | European Pat. Off. . |
| 0220681 | 5/1987 | European Pat. Off. . |
| 2610540 | 8/1988 | France . |
| 2628412 | 9/1989 | France . |

OTHER PUBLICATIONS

M. Paliard et al., "CLE's and Ciments Lafarge's Latest Developments in Roller Press"; Communication presented at the A.F.M.E. symposium on new grinding techniques and energy management; Oct. 26, 1989; four pages.

*Primary Examiner*—Mark Rosenbaum
*Assistant Examiner*—John M. Husar
*Attorney, Agent, or Firm*—Ostrolenk, Faber, Gerb & Soffen

[57] ABSTRACT

A method of crushing brittle materials for obtaining a product of great fineness, wherein the raw material is fed to a roll mill providing a product containing agglomerates and carried into a disaggregator-separator, the fine particles being discharged and the coarse particles being recycled, the disaggregation rate being limited in the disaggregator and the invention being applicable to cement clinker and to various mineral substances.

7 Claims, 1 Drawing Sheet

Fig. 1 PRIOR ART
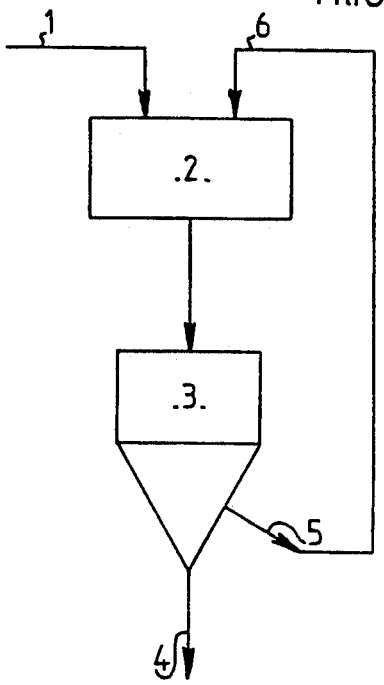
Fig. 2 PRIOR ART
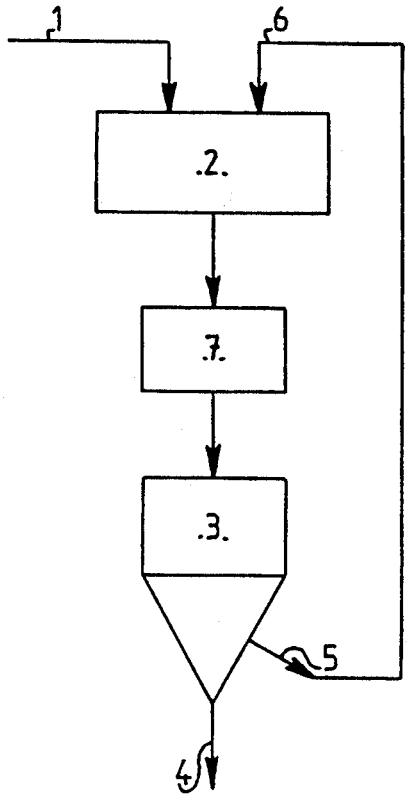
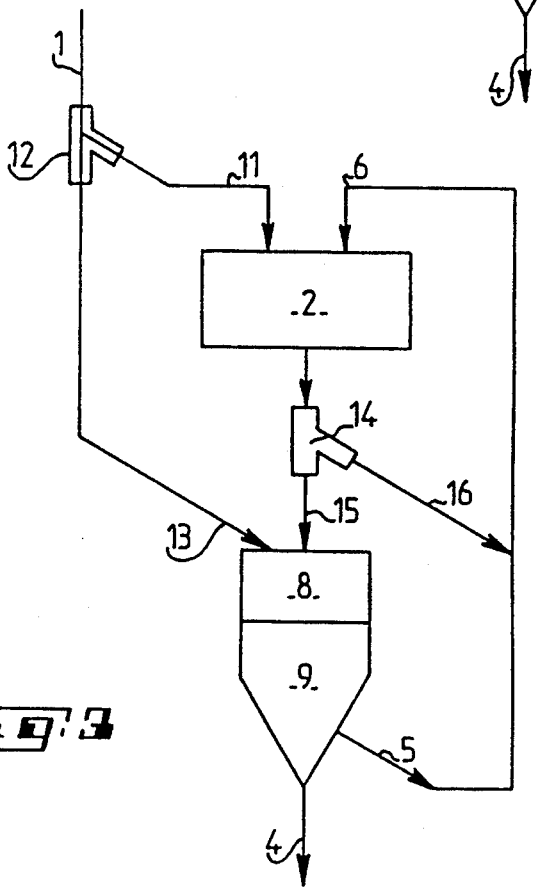
Fig. 3

METHOD AND SYSTEM FOR POUNDING BRITTLE MATERIAL

BACKGROUND OF THE INVENTION

1. Field of the Invention

The present invention relates to an improved method of fine pounding or crushing solid particles of brittle materials in particular of solid particles of brittle mineral materials comprising a selective disaggregation and a system for carrying out the method.

2. Description of the Prior Art

With brittle materials are understood those materials which would break under the action of mechanical forces into smaller fragments even if a resilient deformation would occur before the breakage. The plastics materials which are deformed essentially without any breaking are therefore discarded from this definition.

They have already been proposed to finely crush (grind or mill) more or less coarse solid particles of brittle solid materials by using various devices, in particular crushers or grinding mills with a slow compression such as crushing rolls as disclosed for instance in the French patent specifications Nos. 2,610,540; 2,628,412 and 2,634,402 or also roller mills or some ball-mills which also are leading to the building up of agglomerates or like clusters. The pounding of load or batch particles within these appliances is indeed attended by an agglomeration or clustering of fine particles obtained as aggregates or agglomerates which it is then necessary to dissociate by a subsequent mechanical contribution the strength of which is usually less than that applied during crushing/agglomeration. For that purpose it is possible to use a ball-mill, a distributing sole plate pneumatic separator set or a gauging separator. One may also use an apparatus having a disaggregation action only (European patent specification No. 84,383 and French patent specification No. 2,616,359).

It is also known from these two last documents to recycle one part of the products issuing from the crusher to this same crusher either as such or after a simple mechanical or aeraulic sifting or screening (only those particles or agglomerates which are refused by the sieve are then recycled) or at last after the disintegration and sifting (only non-broken or insufficiently broken particles and not agglomerates since the latter have been disintegrated are then recycled).

With a view to simplify the process and the system one of the inventors has also disclosed and used a system comprising crushing rolls associated with a well performing disaggregation device for the fine pounding, the said disaggregation device being preferably integrated into the separator allowing to select the finished product leaving the pounding system (M. PALIARD-F. COCHET : "Zement, Kalk, Gips", 2, 1990, pages 71 to 76).

In the system thus described the disaggregation device has been chosen as having very good performance data (disaggregation rate of 80 to 85%) for allowing to extract at each passage the greatest possible amount of finished product. The working of the system has shown that this would result in a substantial power consumption for the disaggregation alone and in difficulties to produce the finest cements.

SUMMARY OF THE INVENTION

The object of the present invention is to avoid any useless waste of energy for disaggregating the stoutest or toughest agglomerates built up during the pounding with the press and which have been found that they may be disintegrated very economically by again applying the crushing force through shearing-compression in the press with rolls.

The subject of the invention also is a crushing system allowing the pounding of the finest products under economical conditions with a roll press.

Thus the invention relates to a method and equipment which allow to reduce the overall power consumption and the wear of the equipements in a pounding system mainly comprising a roll press, a disaggregator and a separator for particles, preferably a pneumatic separator.

The effect sought or aimed at is obtained by keeping between 10 and 60% and preferably between 20 and 50% the overall disaggregation rate of the disaggregator placed in the circuit (as measured at d50 for the passed-through material). This has the effect of transferring one part of the work of the disaggregation to the main crushing equipement, namely the roll press where this disaggregation is carried out with a negligible additional cost of energy and wear.

The invention is thus based upon the suprising finding according to which a selective disaggregation allows to more economically use on the one hand the pressure forces of the roll crusher and on the other hand the impact forces of the disaggregator.

The method according to the invention comprises the steps which consist in subjecting to a pounding in a crushing zone with a slow compression, in particular in a roll mill a brittle raw material into starting elementary grains under conditions of build-up of aggregates with smaller elementary grains than the elementary grains of the starting raw material, the said crushing being followed by a controlled disaggregation of the said aggregates in a zone of disaggregation and separation between sufficiently fine particles which are withdrawn from the process and insufficiently fine particles which are recycled to the pounding zone, characterized in that the disaggregation rate (efficiency) is maintained between 10 and 60% and preferaby between 20 and 50% in the disaggregation zone. The disaggregation rate (efficiency) is defined by the weight ratio between the amount of sieve-passing materials released by the disaggregation and the maximum of releasable sieve-passing materials as measured for a determined grain size and preferably for the d50 -mesh of the finished product.

BRIEF DESCRIPTION OF THE DRAWINGS

The invention will be better understood and further objects, characterizing features, details and advantages thereof will appear more clearly as the following description proceeds with reference to the accompanying diagrammatic drawings given by way of non limiting example only illustrating a presently preferred specific embodiment of the invention and wherein:

FIG. 1 shows a known crushing circuit;

FIG. 2 shows another known embodiment of a crushing system; and

FIG. 3 shows a particularly preferred embodiment of the invention.

DETAILED DESCRIPTION OF THE PREFERRED EMBODIMENT

Referring to FIG. 1, raw material supplied through the duct 1 is fed into the crusher 2 and then enters the separator 3. After a selection or sorting the finished product would move out at 4 and the coarser particles which are issuing from the pipeline 5 are recycled to the crusher at 6. This pounding circuit is preferably used when the material does not agglomerate or agglomerates only a little during crushing;

Referring to FIG. 2, the material undergoes an agglomeration during the pounding process. In this case the raw material crushed and agglomerated in the apparatus 2 undergoes a disintegration in the apparatus 7 in order to destroy the built-up agglomerates. The material is then sorted in a separator 3 to extract therefrom the finished product and only the coarsest elementary particles are recycled to the crusher at 6. In the known plants of this type in order to carry out the most thorough or complete disintegration of the material, there is generally used as a disintegrator 7, an apparatus of the percussion crusher, vibrating crusher or ball-mill type. There is thus carried out a disintegration often accompanied by a complementary crushing of the material.

It is obvious that the device according to FIG. 2 may be used for practising the invention. In this case the disaggregation rate is limited in the disaggregator 7 so that it be given a value defined hereinabove.

Referring FIG. 3, raw material fed from the duct 1 is distributed by the directional flap 12 towards the supply of the crusher by the duct 11 and towards the apparatus 8 by the duct 13.

The material crushed and agglomerated in the crusher is divided into two streams or flows by the directional flap valve 14; one portion of this material is directly recycled through the pipeline 16 to the crusher 2 without having undergone any treatment whereas the other fraction of the material is led through the duct 15 into the apparatus 8.

The apparatus 8 is a disaggregator which operates under conditions providing for a partial and selective disaggregation of the aggregates present in the material fed from the duct 15. The apparatus 9 is a separator for instance an aeraulic (pneumatic) separator which receives the material fed from the selective disaggregator 8. The latter is preferably designed so as to be incorporated into the separator 9 for simultaneously performing the disaggregation and sorting functions.

The finished product is discharged from the separator 9 through the pipeline 4 whereas the rejected materials from the separator 9 are discharged through the pipeline 5 and fed back to the crusher 2 together with a material coming from the duct 16.

It is obvious that as an alternative embodiment one may dispense with using the duct 13 and/or the duct 16 as well in this case as the flow dividers 12 and 14.

To obtain a partial and selective disaggregation of the aggregates issuing from the crusher the said aggregates are subjected to mechanical forces preferably controlled shocks. The factors which may be acted upon are for instance the strength of the shocks, their number, the shapes of the surfaces providing these shocks, the speed of rotation in the case of beaters rotating about a shaft and the stay or residence time.

The equipment used for carrying out in the most economical way the partial disaggregation of the product crushed in the roll press is combining shocks preferably with a small impact velocity with hard surfaces and shears in a dense layer of materials "in suspension" in the air or in another inert gas. The average impact speed ranges advantageously from 3 to 100 m/s and preferably from 5 to 30 m/s.

The disaggregator advantageously is a disaggregator with a vertical axis ; it is preferably integrated into the construction of the pneumatic separator and rotated on the same shaft as the selection turbine of the separator (European patent No. 80 104 199.7). With this apparatus the impact blades made from metal ceramic or other wear-resisting material are distributed on a horizontal ring rotating at a speed such that the impact velocity in the center of the blade (mean impact velocity) be preferably comprised between 8 and 26 m/s and still more preferably between 8 and 16 m/s.

Preferred working conditions are described hereinafter.

The impact blades are turning inside of a cylinder lined with a shield plating the relief or embossing of which would oppose the rotary motion of the material carried along by the blades. The size of this relief or embossing is advantageously lying between 1% and 6% of the diameter of this cylinder and preferably between 2% and 4% of the diameter.

The shearing forces are essentially exerted in the shearing chamber located between the impact plates and the shield plating of the outer cylinder. The volume of this chamber is very usefully comprised between 0.0001 and 0.001 $m^3$ per t/h of product co be disaggregated and preferably between 0.00015 and 0.0006 $m^3$ per t/h of product to be disaggregated.

The impact surface of the blades is facing upwards and outwards with respect to the vertical plane which comprises the radius of the disc passing through the center of the plate. The angle of upward orientation is preferably comprised between 3° and 30°, the angle of outward orientation is preferably comprised between 5° and 45°.

The material is supplied through gravity by one or several chutes at the upper face of the ring described by the impact blades and would flow through gravity towards the bottom of the shearing chamber.

In the preferred embodiment the disaggregator is located inside of the pneumatic separator and the material would flow directly from the shearing chamber onto the distributing plate or tray located at the upper face of the selection turbine of the pneumatic separator.

For a better understanding of the invention the terms used or referred to are defined hereinafter.

Elementary grains: they are grains of brittle material characterized by the fact that following the applying of a sufficient force a breaking of these grains occurs without any significant previous plastic deformation (an elastic deformation may however occur).

Aggregates or agglomerates: they are clusters of elementary grains agglomerated to each other and the cohesion of which may be destroyed by applying a force smaller than that required for breaking the elementary grains.

Raw material: it is the material fed for the first time into the crushing system.

Apparent granulometry: it is the granulometry of the material such as taken from the crushing circuit. This material may consist of aggregates and elementary grains.

Elementary granulometry: it is the granulometry of the material having undergone a disaggregation allowing to fully release the elementary grains.

Amount of passing material at a size (d): it the porportion of grains (expressed as a percentage of the total mass of the sample) the average size of which is smaller than (d).

Disaggregation rate: it is defined by the ratio between the amount of passing materials (at a given sifting mesh) released by the disaggregator and the amount of maximum releasable passing materials (at the same sifting mesh).

The disaggregation rate for a crushing circuit is measured preferably for the sifting mesh corresponding to the d50 of the finished product (it is the mesh of the theoretical sieve through which 50% of the finished product would flow).

The disaggregation rate for a given product is measured on the passing material at d50 of the finished product in the following manner:

With a view to obtain a full disaggregation of the product fed to the disaggregator without any additional crushing thereof, this product (A) is suspended in a liquid which does not react therewith and is disperse through mechanical stirring and by applying ultrasounds for a time as long as necessary in order that the granulometry does no longer vary. The liquid is for example an alcohol such as methanol, ethanol or propanol, an ether or a hydrocarbon such as benzene, hexane or the like. After this disaggregation (assumed to be total) the true granulometry (without agglomerates) of the product and in particular the percentage of product passing for the cutting mesh corresponding to the d50 of the finished product is measured by laser-operated granulometry in a liquid medium. The apparent granulometry (least stirring and without applying ultrasounds) of the product such as fed to the disaggregator (A) and such as leaving the latter (S) and in particular the percentage of product passing for the cutting mesh corresponding to the d50 of the finished product is also measured by laser-operated granulometry in a liquid medium.

The d50 mesh of the finished product is measured on the finished product disposed in a liquid medium through stirring and applying of ultrasounds for a period as long as necessary in order that the granulometry does no longer vary. The measurement is effected through laser-operated granulometry in a liquid medium. The d50 mesh is the size such that 50% of the particles are greater than this size and 50% of the particles are smaller than this size.

The disaggregation rate (t) for a given product (as measured at the d50 of the finished product) is defined as follows:

Xt, percentage of passing material at d50 (pf) after full disaggregation of the product.

Xa, percentage of passing material at d50 (pf) at the supply or inlet of the mechanical disaggregator.

Xs, percentage of passing material at d50 (pf) at the outlet of the mechanical disaggregator.

$$t(\%) = \frac{Xs - Xa}{Xt - Xa} \times 100$$

By way of example a system is operated comprising a roll crusher fed with cement clinker, a disaggregator and a pneumatic sorter. The granulometry before and after passage into the disaggregator has been analysed according to the method explained hereinabove and the following results have been obtained:

$d50(pf) = 16.10^{-3}$ mm $Xt = 9.4\%$ $Xa = 6.9\%$ $Xs = 7.7\%$ wherefrom $$t(\%) = 100 \times \frac{7.7 - 6.9}{9.4 - 6.9}$$

$$t(\%) = 32\%$$

The advantages obtained by the method are in particular the following:

With a same amount of product the crushing method according to the invention allows to reduce by more than 50% the disaggregation power without increasing the crushing power with respect to the prior state of the art, that is a saving of 0.2 to 0.6 kWh/t of finished product. This would correspond to a saving of 1 to 3% on the crushing of in particular fine cements (Blaine surface greater than 3,500 $cm^2/g$); a very substantial amount of fine particles smaller than 200 microns has to be recycled to the press, these particles by trapping air in the batch load would cause an unstable flow of the material in the press. The crushing method according to the invention allows to recycle these fine particles as agglomerates providing for the stability of supply of the batch load to the press. For greater finenesses the method according to the invention allows to increase by 20 to 100% the speed of rotation of the press hence its flow rate.

At last at the disaggregator itself the crushing method according to the invention allows to use the same drive (motor, speed-reducer, shaft) for the disaggregator and the pneumatic selector thereby being a source of investment and maintenance savings and this without resorting to sophisticated systems (multiple rows of crushing fingers for example) which are expensive in terms of wearing parts.

The invention relates also to a system for carrying out the method described hereinabove. This system comprises at least one slow-compression crusher, means for disaggregating and sorting the product issuing from the slow-compression crusher and means for collecting the sorted fine particles and for returning to the slow-compression crusher the sorted coarse particles. This system is fitted with means for taking and analysing at least one fraction of the products at the feed of the disaggregating means and at least one fraction of the products issuing from the disaggregator, the analysing means being adapted to determine the disaggregation rate between the inlet and the outlet of the disaggregation means.

Preferably the system is such that the crusher is a roll mill and the disaggregating and sorting means comprise means for simultaneously suspending the particles in the gas and subjecting the particles suspended in the gas to shocks and separating the relatively fine particles from the relatively coarse particles which result from these shocks.

What is claimed is:

1. A method of fine crushing solid particles of brittle materials, comprising the steps of crushing a brittle raw material in a slow crushing zone under conditions of at least partial build-up of aggregates, said brittle raw material being in the form of starting elementary grains, said aggregates comprising particles having a passing size of a desired fine product and particles greater than said passing size, said crushing being followed by controlled disaggregating of said aggregates in a disaggregation zone and by separating and withdrawing particles having said passing size which constituted the the desired fine product and recycling particles greater than said passing size to the crushing zone, and maintaining the rate of said controlled disaggregating between 10 and 60% in the disaggregation zone, the disaggregating rate being defined by the weight ratio of the amount of particles having said passing size released from said aggregates during said disaggregating to the amount of particles having said passing size present in said aggregates before said disaggregating.

2. A method according to claim 1, wherein the disaggregating step includes a disaggregation rate between 20 and 50%.

3. A method according to claim 1, wherein the disaggregating step includes subjecting the aggregates to shocks with hard surfaces.

4. A method according to claim 3, wherein the shocks are performed with an average impact speed of 3 to 100 m/s.

5. The method of claim 4, wherein the shocks are performed with an average impact speed of 5 to 30 m/s.

6. A method according to claim 1, further comprising the step of separating and discharging the particles having the passing size released during said disaggregating by carrying the fine particles along or away by air.

7. The method of claim 1, wherein the crushing step comprises crushing the raw material in a roll mill.

* * * * *

UNITED STATES PATENT AND TRADEMARK OFFICE

CERTIFICATE OF CORRECTION

PATENT NO. : 5,333,798

DATED : August 2, 1994

INVENTOR(S) : Maurice Paliard and Jacques Dupuis

It is certified that error appears in the above-indentified patent and that said Letters Patent is hereby corrected as shown below:

On the title page: Item [75] please delete "Jacques Duputs" and insert -- Jacques Dupuis --.

Signed and Sealed this

Fourth Day of April, 1995

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,333,798

DATED : August 2, 1994

INVENTOR(S) : Maurice Paliard, et al

It is certified that error appears in the above-indentified patent and that said Letters Patent is hereby corrected as shown below:

On title page, item [73], delete "Courbevote," and insert —Courbevoie,—

Signed and Sealed this

Twenty-seventh Day of June, 1995

*Attest:*

Bruce Lehman

BRUCE LEHMAN

*Attesting Officer*

*Commissioner of Patents and Trademarks*